US006448950B1

(12) United States Patent
Cheng

(10) Patent No.: US 6,448,950 B1
(45) Date of Patent: Sep. 10, 2002

(54) ENERGY EFFICIENT RESONANT SWITCHING ELECTROLUMINESCENT DISPLAY DRIVER

(75) Inventor: Chun-Fai Cheng, Newmarket (CA)

(73) Assignee: iFire Technology Inc., Fort Saskatchewan AB Alberta (CA)

( * ) Notice: Subject to any disclaimer, the term of this patent is extended or adjusted under 35 U.S.C. 154(b) by 0 days.

(21) Appl. No.: 09/504,472

(22) Filed: Feb. 16, 2000

(51) Int. Cl.[7] ..... G09G 3/30

(52) U.S. Cl. ..... 345/76; 345/211; 345/212; 345/213; 345/208; 345/77; 315/239; 315/169.3; 315/160; 315/240; 315/242

(58) Field of Search ..... 345/76, 211, 77, 345/212, 214, 213, 90, 208; 363/97; 315/160, 169.3, 234, 240, 242

(56) References Cited

U.S. PATENT DOCUMENTS

| | | | | |
|---|---|---|---|---|
| 4,349,816 A | | 9/1982 | Miller et al. | |
| 4,574,342 A | | 3/1986 | Runyan | |
| 4,633,141 A | | 12/1986 | Weber | |
| 4,707,692 A | | 11/1987 | Higgins et al. | |
| 5,027,040 A | | 6/1991 | Ikeda et al. | |
| 5,293,098 A | | 3/1994 | Brownell | |
| 5,315,311 A | | 5/1994 | Honkala | |
| 5,432,015 A | | 7/1995 | Wu et al. | |
| 5,440,208 A | | 8/1995 | Uskali et al. | |
| 5,559,402 A | | 9/1996 | Corrigan, III | |
| 5,566,064 A | | 10/1996 | Schoenwald et al. | |
| 5,754,064 A | * | 5/1998 | Chien | 327/108 |
| 5,793,342 A | * | 8/1998 | Rhoads | 345/76 |
| 6,317,338 B1 | * | 11/2001 | Boys | 363/25 |

OTHER PUBLICATIONS

Journal Article by C. King.

* cited by examiner

*Primary Examiner*—Richard Hjerpe
*Assistant Examiner*—Ali Zamani
(74) *Attorney, Agent, or Firm*—Fay, Sharpe, Fagan, Minnich & McKee, LLP

(57) ABSTRACT

A driving circuit for powering an electroluminescent display using energy recovered from a varying panel capacitance of the display. The driving circuit comprises a source of electrical energy; and a resonant circuit using the panel capacitance for receiving the electrical energy and in response generating a sinusoidal voltage to power the display at a resonance frequency which is substantially synchronized to a scanning frequency of the display. The resonant circuit uses a step down transformer to reduce the effective panel capacitance of the display in order to reduce its effect on the resonance frequency.

28 Claims, 9 Drawing Sheets

Waveform distortion due to resonant frequency too high

Waveform distortion due to resonant frequency too low

Row drive polarity switch output showing +ve and -ve display cycle (6 lines per frame shown)

ENERGY EFFICIENT RESONANT SWITCHING ELECTROLUMINESCENT DISPLAY DRIVER

FIELD OF THE INVENTION

The present invention relates generally to flat panel displays, and more particularly to a resonant switching panel driving circuit where the panel imposes a variable high capacitive load on the driving circuit.

BRIEF DESCRIPTION OF THE DRAWINGS

The Background of the Invention and Detailed Description of the Preferred Embodiment are set forth herein below with reference to the following drawings, in which.

BACKGROUND OF THE INVENTION

Electroluminescent displays are advantageous by virtue of their low operating voltage with respect to cathode ray tubes, their superior image quality, wide viewing angle and fast response time over liquid crystal display, and their superior gray scale capability and thinner profile than plasma display panels. They do have relatively high power consumption, however, due to the inefficiencies of pixel charging as discussed in greater detail below. This is the case even though the conversion of electrical energy to light within a pixel is relatively efficient. However, the disadvantage of high power consumption associated with electroluminescent displays can be mitigated if the capacitive energy stored in the electroluminescent pixels can be efficiently recovered.

The present invention relates to energy efficient methods and circuits for driving display panels where the panel imposes a variable capacitive load on the driving circuit. The invention is particularly useful for electroluminescent displays where the panel capacitance is high. The panel capacitance is the capacitance as seen on the row and column pins of the display. Electroluminescent display pixels have the characteristic that the pixel luminance is zero if the voltage across the pixel is below a defined threshold voltage, and becomes progressively greater as the voltage is increased beyond the threshold voltage. This property facilitates the use of matrix addressing to generate a video image on the display panel.

Figure 1:
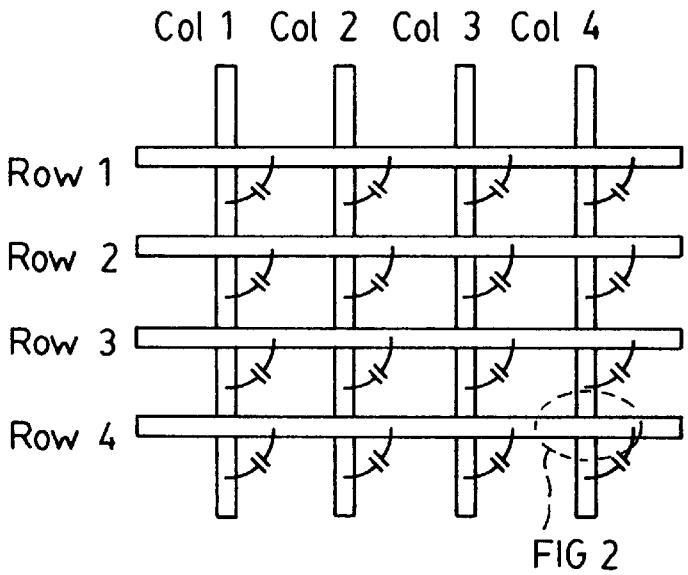
FIG. 1 is a plan view of an arrangement of rows and columns of pixels on an electroluminescent display, in accordance with the Prior Art.
Figure 2:
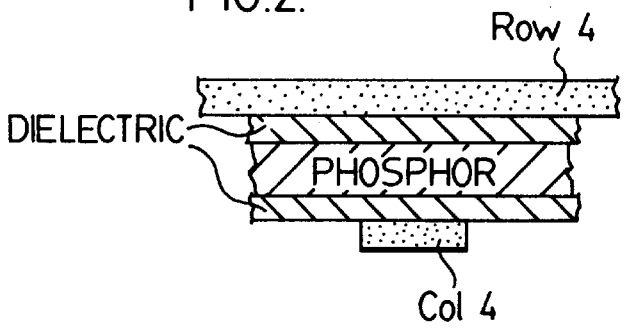
FIG. 2 is a cross section through a single pixel of the electroluminescent display of FIG. 1.

As shown in FIGS. 1 and 2, an electroluminescent display has two intersecting sets of parallel electrically conductive address lines called rows (ROW 1, ROW 2, etc.) and columns (COL 1, COL 2, etc.) that are disposed on either side of a phosphor film encapsulated between two dielectric films. A pixels is defined as the intersection point between a row and a column. Thus, FIG. 2 is a cross-sectional view through the pixel at the intersection of ROW 4 and COL 4, in FIG. 1. Each pixel is illuminated by the application of a voltage across the intersection of row and column. Matrix addressing entails applying a voltage below the threshold voltage to a row while simultaneously applying voltages of the opposite polarity to each column that intersects that row. The opposite polarity voltage augments the row voltage in accordance with the illumination desired on the respective pixels, resulting in generation of one line of the image. An alternate scheme is to apply the maximum pixel voltage to a row and apply column voltages of the same polarity to all columns with a magnitude up to the difference between the maximum voltage and the threshold voltage, in order to decrease the pixel voltages in accordance with the desired image. In either case, once each row is addressed, another row is addressed in a similar manner until all of the rows have been addressed. Rows not being addressed are left at open circuit. The sequential addressing of all rows constitutes a complete frame. Typically, a new frame is addressed at least about 50 times per second to generate what appears to the human eye as a flicker-free video image.

When each row of an electroluminescent display is illuminated, a portion of the energy supplied to the illuminated pixels is dissipated as current flows through the pixel phosphor layer to generate light, but a portion remains stored on the pixel once light emission has ceased. This residual energy remains on the pixel for the duration of the applied voltage pulse, and typically represents a significant fraction of the energy supplied to the pixel. As discussed in greater detail below, an object of an aspect of the present invention is to recover this residual energy for driving the rows and columns of the display.

Figure 3:
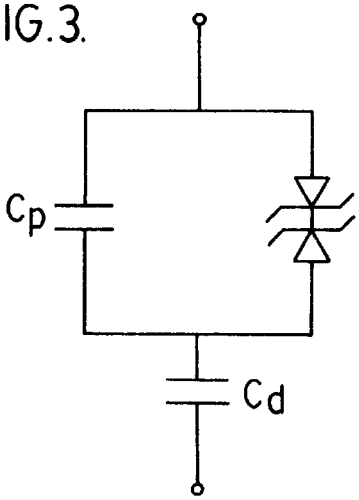
FIG. 3 is an equivalent circuit for the pixel of FIG. 2.

FIG. 3 is an equivalent circuit which models the electrical properties of the pixel. The circuit comprises two back-to-back Zener diodes with a series capacitor labelled $C_d$ and a parallel capacitor labelled $C_p$. Physically, the phosphor and dielectric films (FIG. 2) are both insulators below the threshold voltage. This is represented in FIG. 3 by the situation where one Zener diode is not conducting so that the pixel capacitance is the capacitance of the series combination of the two capacitors $C_d$ and $C_p$. Above the threshold voltage, the phosphor film becomes conductive, corresponding to the situation where both Zener diodes are conducting such that the pixel capacitance is equal to that of the series capacitor only. Thus, the pixel capacitance is dependent on whether the voltage is above or below the threshold voltage. Further, because all of the pixels on the display are coupled to one another through the rows and columns, all of the pixels on the panel may be at least partially charged when a single row is illuminated. The extent of the partial charging of the pixels on non-illuminated rows is highly dependent on the variability of the simultaneous column voltages. In the case where all column voltages are the same, no partial charging of the pixels on non-illuminated rows occurs. In the case where about half of the columns have little or no applied voltage and the remaining half have close to the maximum voltage, the partial charging is most severe. The latter situation arises frequently in presentation of video images. The energy associated with this partial charging is typically much greater than the energy stored in the illuminated row, especially if there are a large number of rows, as in a high-resolution panel. All of the energy stored in non-illuminated rows is potentially recoverable, and may amount to more than 90% of the energy stored in the pixels, particularly for panels with a large number of rows.

Another factor contributing to energy consumption is the energy dissipated in the resistance of the driving circuit and the rows and columns during charging of the pixels. This dissipated energy may be comparable in magnitude to the energy stored in the pixels if the pixels are charged at a constant voltage. In this case, there is an initial high current surge as the pixels begin to charge. It is during this period of high current that most of the energy is dissipated since the dissipation power is proportional to the square of the current. The dissipated energy can be reduced by making the current flow during pixel charging closer to a constant current. This has been addressed, for example by C. King in SID International Symposium Lecture Notes 1992, May 18, 1992, Volume 1, Lecture no. 6, through the application of a stepped voltage pulse rather than a single square voltage pulse as is done conventionally in the electroluminescent display art. However, the circuitry required to provided stepped pulses adds complexity and cost.

Sinusoidal driving waveforms have also been employed to reduce resistive energy loss. U.S. Pat. No. 4,574,342 teaches the use of a sinusoidal supply voltage generated using a DC to AC inverter and a resonant tank circuit to drive an electroluminescent display panel. The panel is connected in parallel with the capacitance of the tank circuit. The supply voltage is synchronized with the tank circuit so as to maintain the voltage amplitude in the tank at a constant level independent of the load associated with the panel. The use of the sinusoidal driving voltage eliminates high peak currents associated with constant voltage driving pulses and therefore reduces $I^2R$ losses associated with the peak current, but does not effect recovery of capacitive energy stored in the panel.

U.S. Pat. No. 4,707,692 teaches the use of an inductor in parallel with the capacitance of the panel to effect partial energy recovery. This scheme requires a large inductor to achieve a resonance frequency commensurate with the timing constraints inherent in display operation, and does not allow for efficient energy recovery over a wide range of panel capacitance, which, as discussed above is commonly encountered with electroluminescent displays. U.S. Pat. No. 5,559,402 teaches a similar inductor switching scheme by which two small inductors and a capacitor which are external to the panel sequentially release small energy portions to the panel or accept small energy portions from the panel. However, only a portion of the stored energy can be recovered. U.S. Pat. No. 4,349,816 teaches energy recovery by means of incorporating the display panel into a capacitive voltage divider circuit that employs large external capacitors to store recovered energy from the panel. This scheme increases the capacitive load on the driver which, in turn, increases the load current and increases resistive losses. None of these three patents teaches reduction of resistive losses by using sinusoidal drivers.

U.S. Pat. Nos. 4,633,141; 5,027,040; 5,293,098; 5,440,208 and 5,566,064 teach the use of resonant sinusoidal driving voltages to operate an electroluminescent lamp element and recover a portion of the capacitive energy in the lamp element. However, these schemes do not facilitate efficient energy recovery when there is a large random short term variation in the panel capacitance. In fact, accommodation of such capacitance changes is not a requirement for the operation of electroluminescent lamps where the panel capacitance is fixed, other than to compensate for slow changes due to the aging characteristics of the panel.

U.S. Pat. No. 5,315,311 teaches a method of saving power in an electroluminescent display. This method involves sensing when the power demand from the column drivers is highest in a situation where the pixel voltage is the sum of the row and column voltages, and then reducing the column voltage, and correspondingly increasing the selected row voltage. The method does not facilitate reduction of resistive losses by limiting peak currents, nor does it recover capacitive energy from the panel. Research suggests that the method of this patent degrades the contrast ratio for the display, since any pixels in the selected row that are meant to be off will be somewhat illuminated due to the row voltage being somewhat above the threshold voltage. Thus, this prior art power saving method does not work well in conjunction with gray scale capability.

SUMMARY OF THE INVENTION

An object of an aspect of the present invention is to provide an electroluminescent display driving method and circuit that simultaneously recovers and re-uses the stored capacitive energy in a display panel and minimizes resistive losses attributable to high instantaneous currents. These features improve the energy efficiency of the panel and driver circuit, thereby reducing their combined power consumption. A further objective is to facilitate a brighter display by reducing the rate of heat dissipation in the display panel and driver circuit so that the panel pixels can be driven at higher voltage and higher refresh rates, thereby increasing brightness. An additional benefit of the invention over prior art display driver methods and circuits is reduced electromagnetic interference due to the use of a sinusoidal drive voltage rather than a pulse drive voltage. The use of a sinusoidal drive voltage eliminates the high frequency harmonics associated with discrete pulses. The advantages given above are accomplished without the need for expensive high voltage DC/DC converters.

The energy efficiency of the display panel and driving circuit of the present invention is improved through the use of two resonant circuits to generate two sinusoidal voltages, one to power the display rows and one to power the display columns. The row capacitance, as seen on the row pins of the display, forms one element of the resonant circuit for the row driving circuit. The column capacitance, as seen on the column pins of the display, forms one element of the resonant circuit for the column driving circuit.

The energy in each resonant circuit is periodically transferred back and forth between capacitive elements and inductive elements. The resonant frequency of each of the resonant circuits is tuned so that the period of the oscillations is matched as closely as possible, synchronized, to the charging of successive panel rows, the scanning frequency of the display, as configured.

When the energy is stored inductively, a switch that connects the row resonant circuit to a particular row is activated so as to direct the energy stored inductively to the appropriate row as the rows are addressed in sequence. The row driving circuit for the rows also includes a polarity reversing circuit that reverses the row voltage on alternate frames in order to extend the service life of the display.

In a similar manner, the column driving circuit connects the column resonant circuit to all of the columns simultaneously so as to direct energy stored inductively to the columns. The column switches, as is taught in the conventional art, also serve to control the quantity of energy fed to each column in order to effect gray scale control. Typically, the row switches and column switches are packaged as an integrated circuit in sets of 32 or 64 and are respectively called row drivers and column drivers.

Other and further advantages and features of the invention will be apparent to those skilled in the art from the following detailed description thereof, taken in conjunction with the accompanying drawings.

DESCRIPTION OF THE PREFERRED EMBODIMENTS

Figure 4:
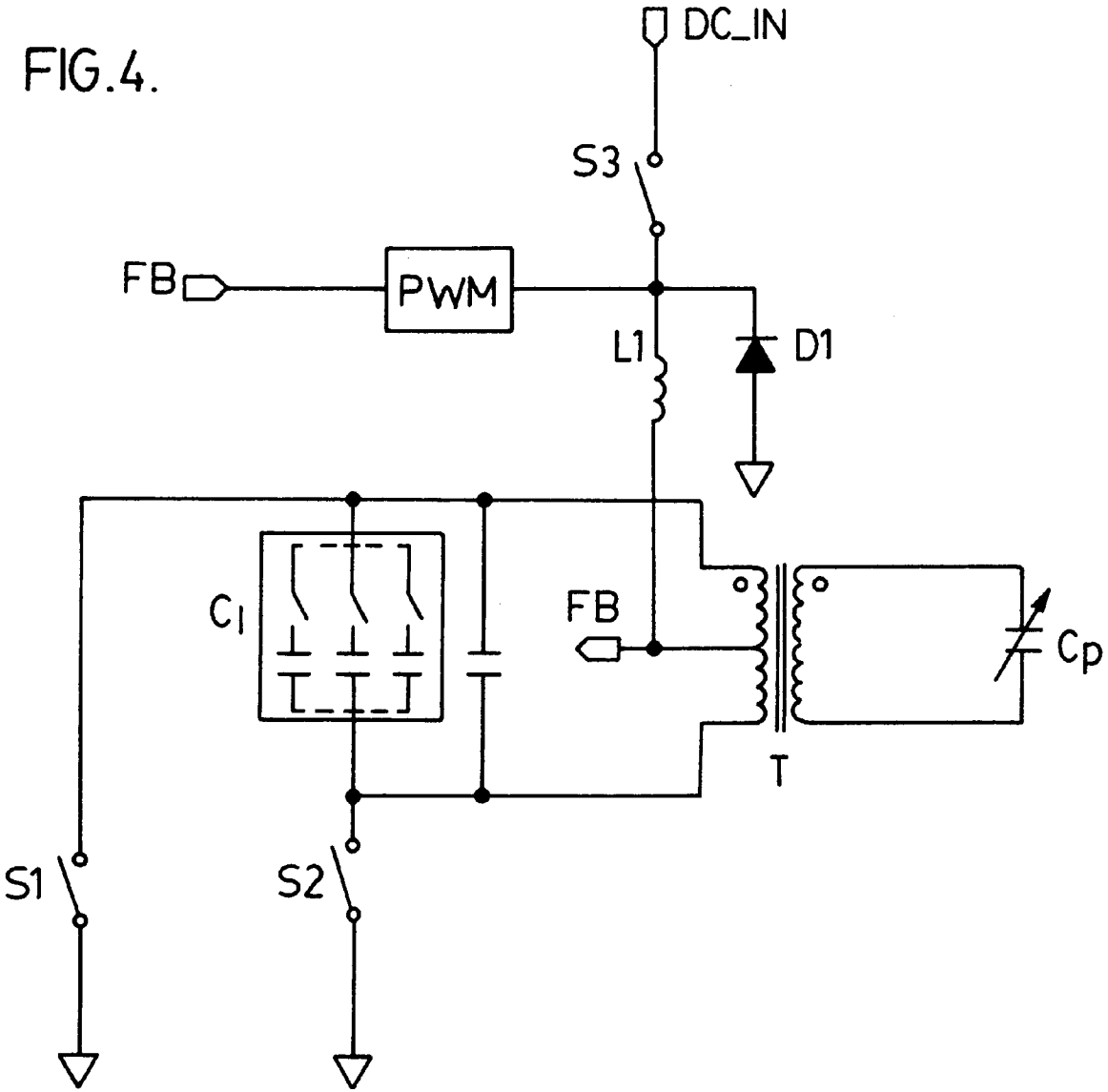
FIG. 4 is a simplified circuit schematic of a resonant circuit used in the display driver according to the present invention.

FIG. 4 is a simplified schematic of a resonant circuit according to the invention. The basic element is a resonant voltage inverter forming a resonant tank that comprises a step down transformer (T), a capacitance corresponding to the panel capacitance ($C_p$) connected across the secondary winding of the transformer and a further capacitor ($C_1$) connected across the primary winding of the transformer. The further capacitance ($C_1$) may include a bank of capacitors that can be selected to synchronize the resonant frequency with different display scanning frequencies.

The resonant circuit also comprises two switches ($S_1$ and $S_2$) that alternately open and close when the current is zero in order to invert an incoming sinusoidal signal to a unipolar resonant oscillation. An input DC voltage is chopped by switch ($S_3$) under control of a pulse width modulator (PWM) to control the voltage amplitude of the resonant oscillation. To stabilize the voltage of the oscillations, a signal (FB) is fed back from the primary of the transformer to the PWM to adjust the on-to-off time ratio for the switch ($S_3$) in response to fluctuations in the voltage on the secondary. This feedback compensates for voltage changes due to variations in the panel impedance resulting, in turn, from changes in the displayed image. The panel impedance is the impedance as seen on the row and column pins of the display.

To operate efficiently, the resonant frequency of the driving circuit must not vary appreciably so that the resonant frequency remains closely matched to the frequency of row addressing timing pulses. The resonant frequency f is given by equation 1

$$f=1/(2\pi(LC)^{1/2}) \quad (1)$$

where L is the inductance and C is the capacitance of the tank in the resonant circuit. The resonant circuit must account for the variability in the panel capacitance that contributes to the total tank capacitance. This is accomplished by use of the step down transformer which reduces the contribution of the panel capacitance ($C_p$) to the tank capacitance so that the effective tank capacitance C is given by equation 2 where, $C_p$ is the panel capacitance, C1 is the value of the capacitance across the primary winding of the transformer and $n_1$, and $n_2$ are the number of turns respectively on the primary and secondary windings of the transformer.

$$C=(n_2/n_1)^2C_P+C_1 \quad (2)$$

Figure 5A:
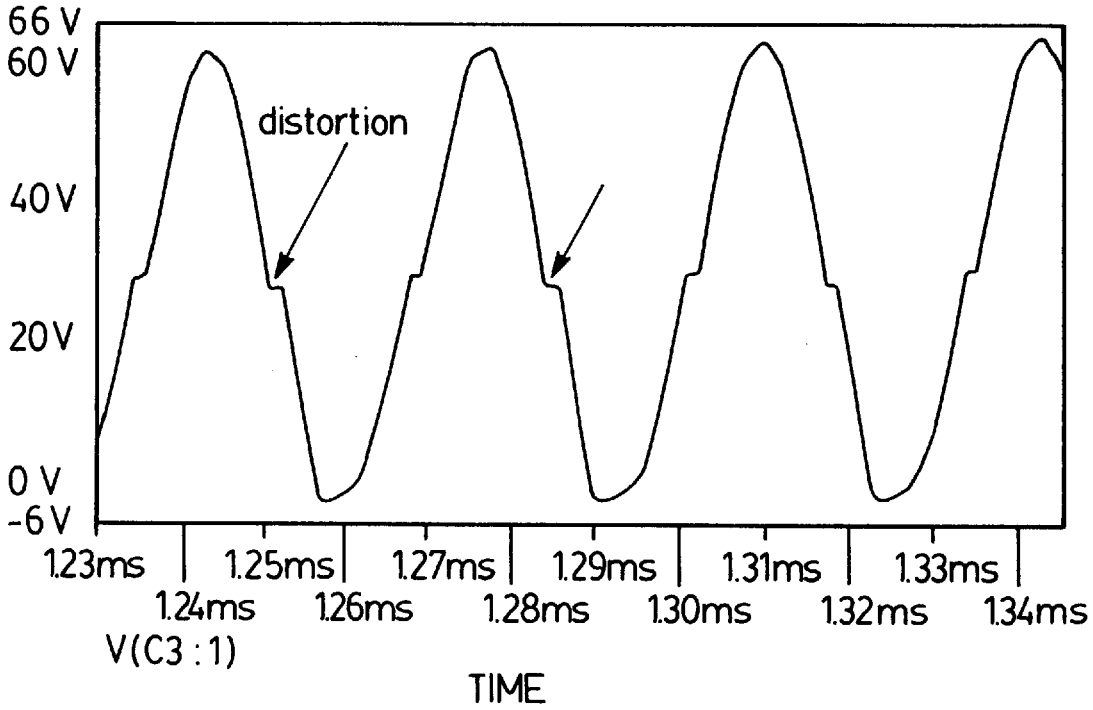
FIGS. 5A–5C are oscilloscope tracings which show waveforms for the resonant circuit of FIG. 4 under different conditions.
Figure 5B:
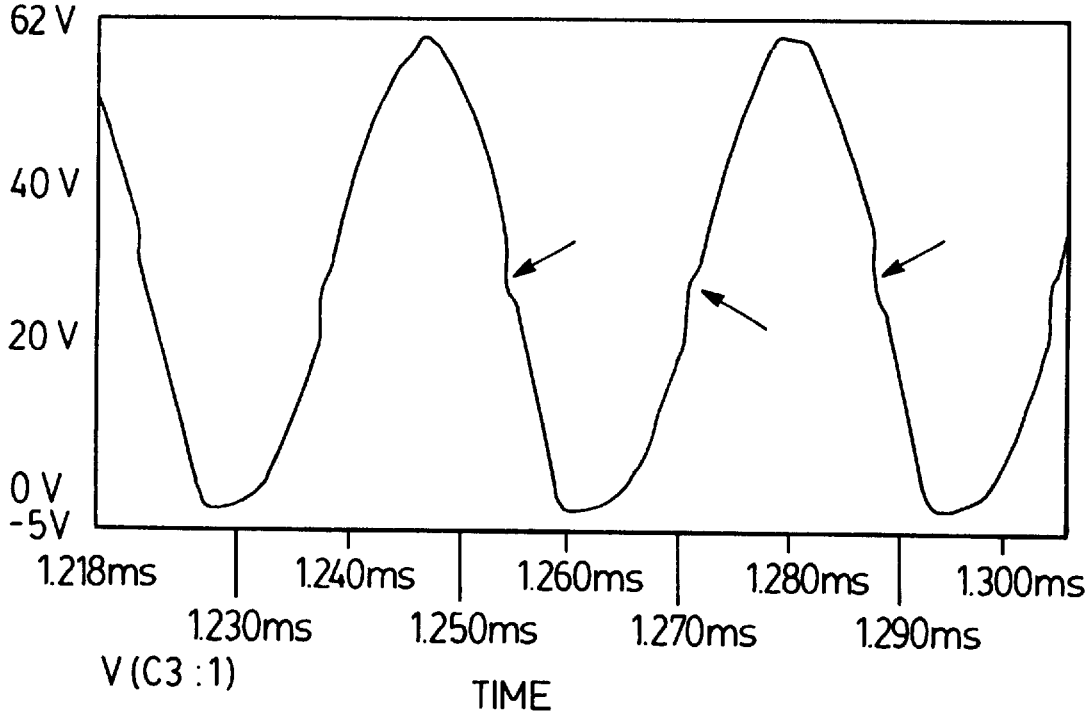
Figure 5C:
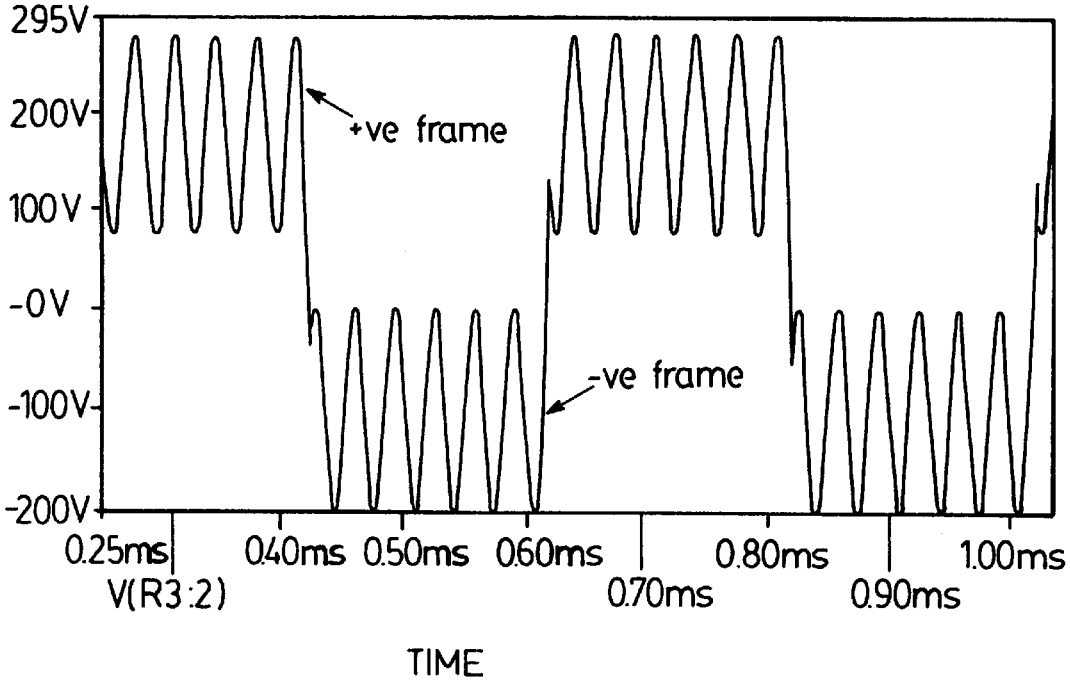

Values for the ratio of the number of turns ($n_2/n_1$) and $C_1$ are chosen so that the first term in equation 2 is small compared with the second term. Equation 2 is used as a guide in determining appropriate values for the turns-ratio and the primary capacitance for a particular panel, and mutual optimization of these values is then accomplished by examining the voltage waveforms measured at the input to the resonant circuit. Component values are then selected to minimize the deviation from a sinusoidal signal. If the resonant frequency is too high, a waveform exemplified by that shown in FIG. 5*a* will be observed where there is a zero voltage interval between the alternate polarity segments of the waveform. Appropriate adjustments are then made using equations 1 and 2 as a guide. If the resonant frequency is too low, a waveform exemplified by that shown in FIG. 5*b* will be observed, where there is a vertical voltage step crossing zero volts connecting alternate polarity segments of the waveform. If the resonant frequency is well matched to the row addressing frequency, a nearly perfect sinusoidal waveform will be observed, as shown in FIG. 5*c*.

Figure 6:
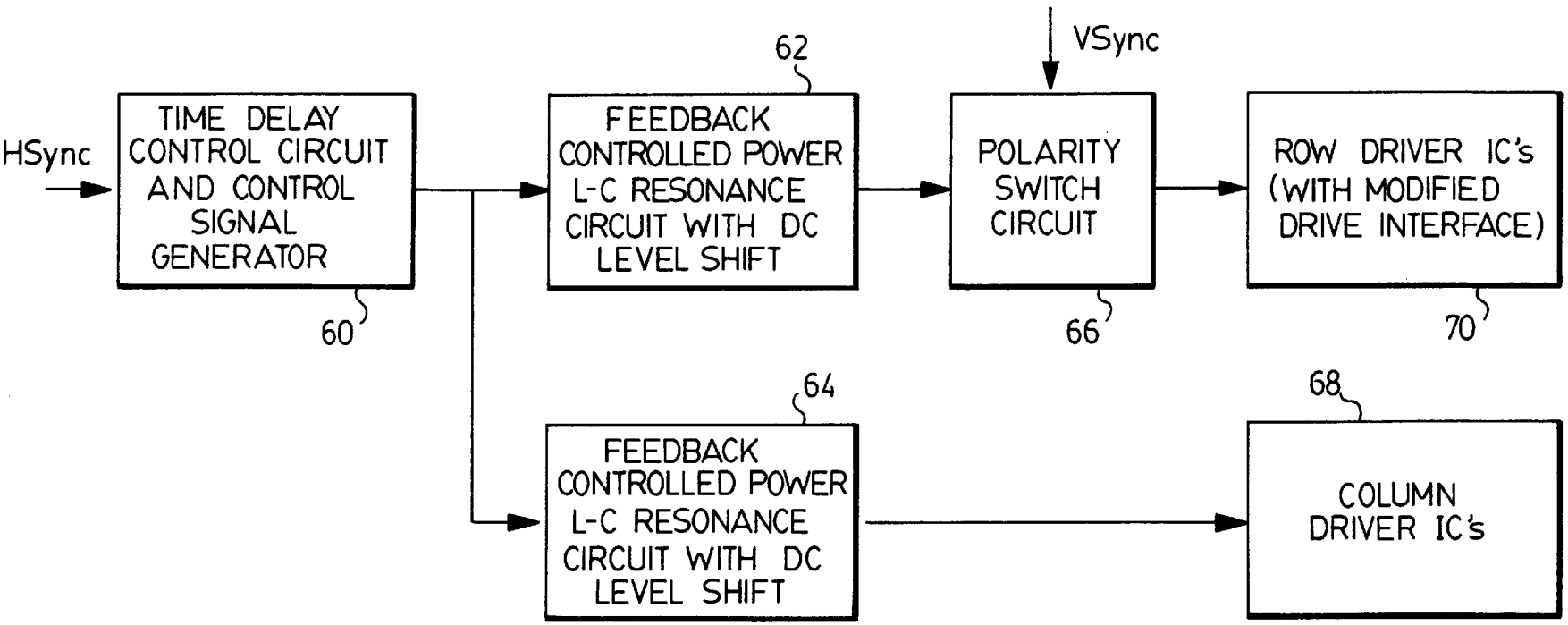
FIG. 6 is a block diagram of a complete display driver incorporating the elements of the present invention.

A block diagram of a complete display driver is shown in FIG. 6. In the diagram HSync refers to timing pulses that initiate addressing of a single row. The HSync pulses are fed to a time delay control circuit 60 where the delay time is set so that the zero current times in the resonant circuit will correspond to the switching times for the rows and columns. The output of circuit 60 is applied to row and column resonant circuits 62 and 64, and the output of circuit 62 is applied to polarity switching circuit 66. The switching times for the polarity switching circuit 66 are controlled by the VSync pulses to control the timing for initiating each complete frame. The outputs of circuits 64 and 66 are applied to the column and row driver ICs 68 and 70, respectively.

Returning momentarily to FIG. 2, the preferred embodiment for the present invention is optimized for use with an electroluminescent display having a thick film dielectric layer. Thick film electroluminescent displays differ from conventional thin film electroluminescent displays in that one of the two dielectric layers comprises a thick film layer having a high dielectric constant. The second dielectric layer is not required to withstand a dielectric breakdown since the thick layer provides this function, and can be made substantially thinner than the dielectric layers employed in thin film electroluminescent displays. U.S. Pat. No. 5,432,015 teaches methods to construct thick film dielectric layers for these displays. As a result of the nature of the dielectric layers in thick film electroluminescent displays, the values in the equivalent circuit shown in FIG. 3 are substantially different than those for thin film electroluminescent displays. In particular, the values for $C_d$ can be significantly larger than they are for thin film electroluminescent displays. This makes the variation in panel capacitance as a function of the applied row and column voltages greater than it is for thin film displays, and provides a greater impetus for the use of the present invention in thick film displays. The ratio of the pixel capacitance above the threshold voltage to that below the threshold voltage is typically about 4:1 but can exceed 10:1. By contrast, for thin film electroluminescent displays this ratio is in the range of about 2:1 to 3:1. Typically the panel capacitance can range from the nanofarad range to the microfarad range, depending on the size of the display and the voltages applied to the rows and columns.

A row driver circuit and a column driver circuit have been built according to a successful reduction to practice of the present invention, for an 8.5 inch 240 by 320 pixel quarter VGA format diagonal thick film colour electroluminescent display. Each pixel has independent red, green and blue sub-pixels addressed through separate columns and a common row. The threshold voltage for the prototype display was 150 volts. The panel capacitance for this display measured at an applied voltage of less than 10 volts between a row and the columns with all of the columns at a common potential was 7 nanofarads. The panel capacitance measured at a similar voltage between a row and a column but with half of the remaining columns at a common potential with the selected column and the remaining columns at a voltage of 60 volts with respect to the selected column was 0.4 microfarads, a much larger value.

Figure 7:
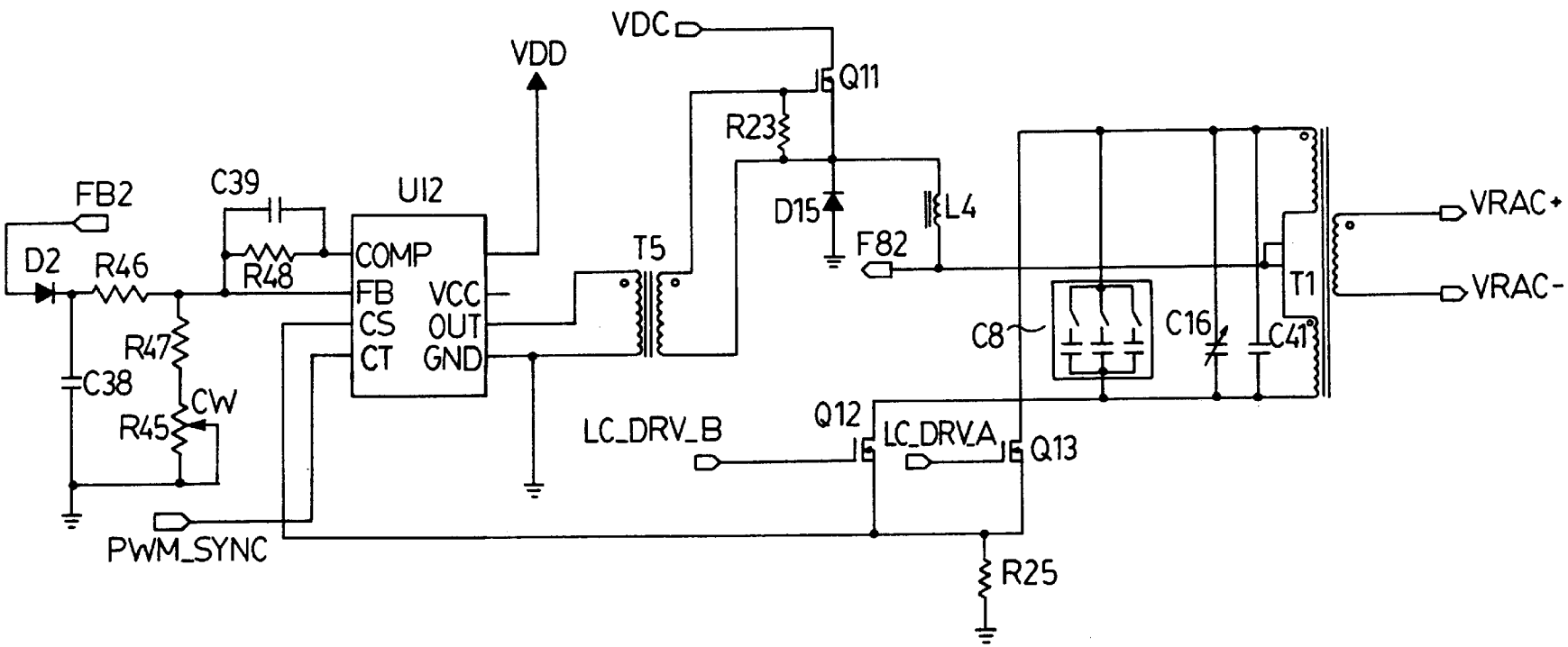
FIG. 7 is a detailed circuit diagram for a preferred embodiment of a row driver incorporating the elements of the present invention.
Figure 8:
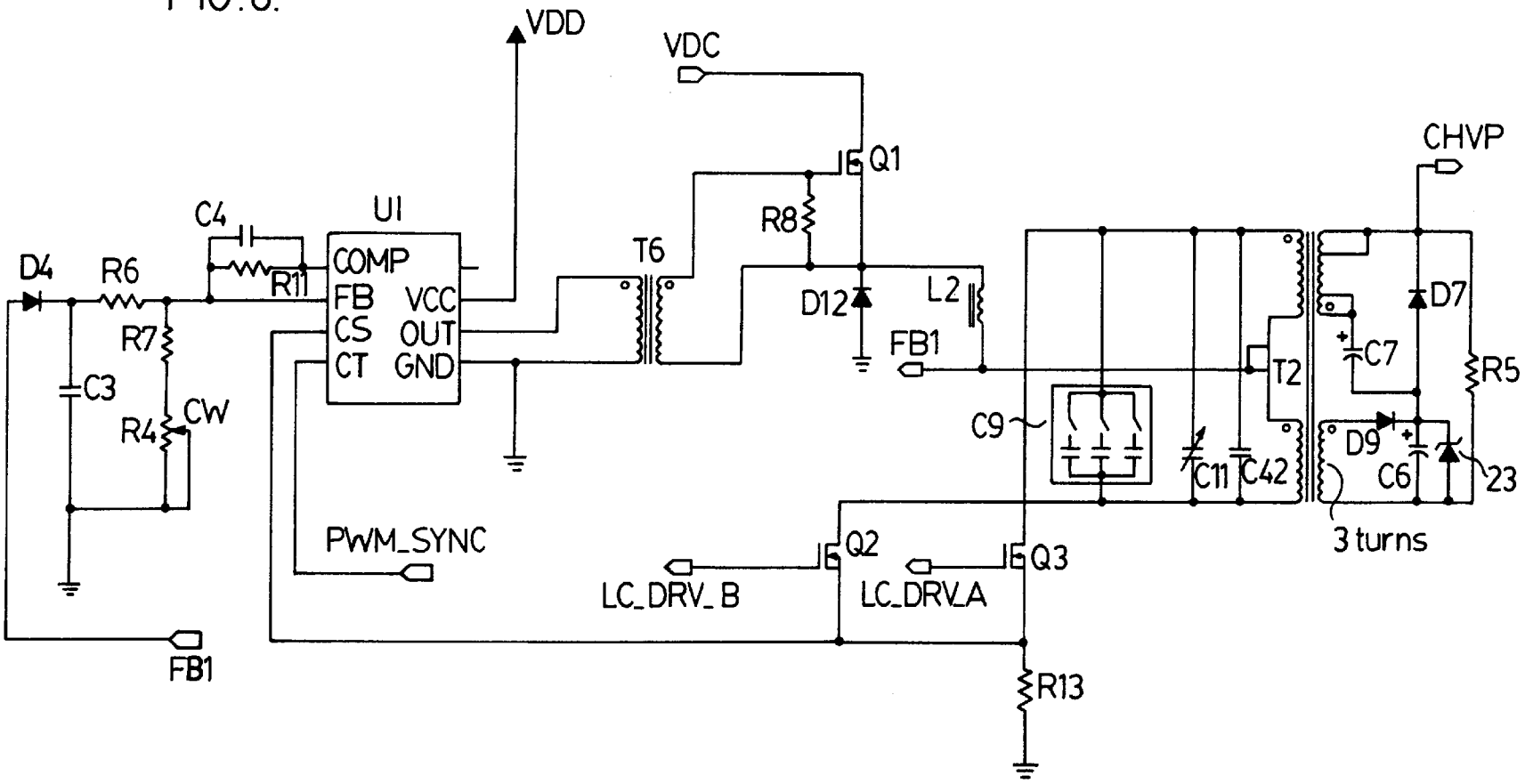
FIG. 8 is a detailed circuit diagram for a embodiment of a column driver incorporating the elements of the present invention.
Figure 9:
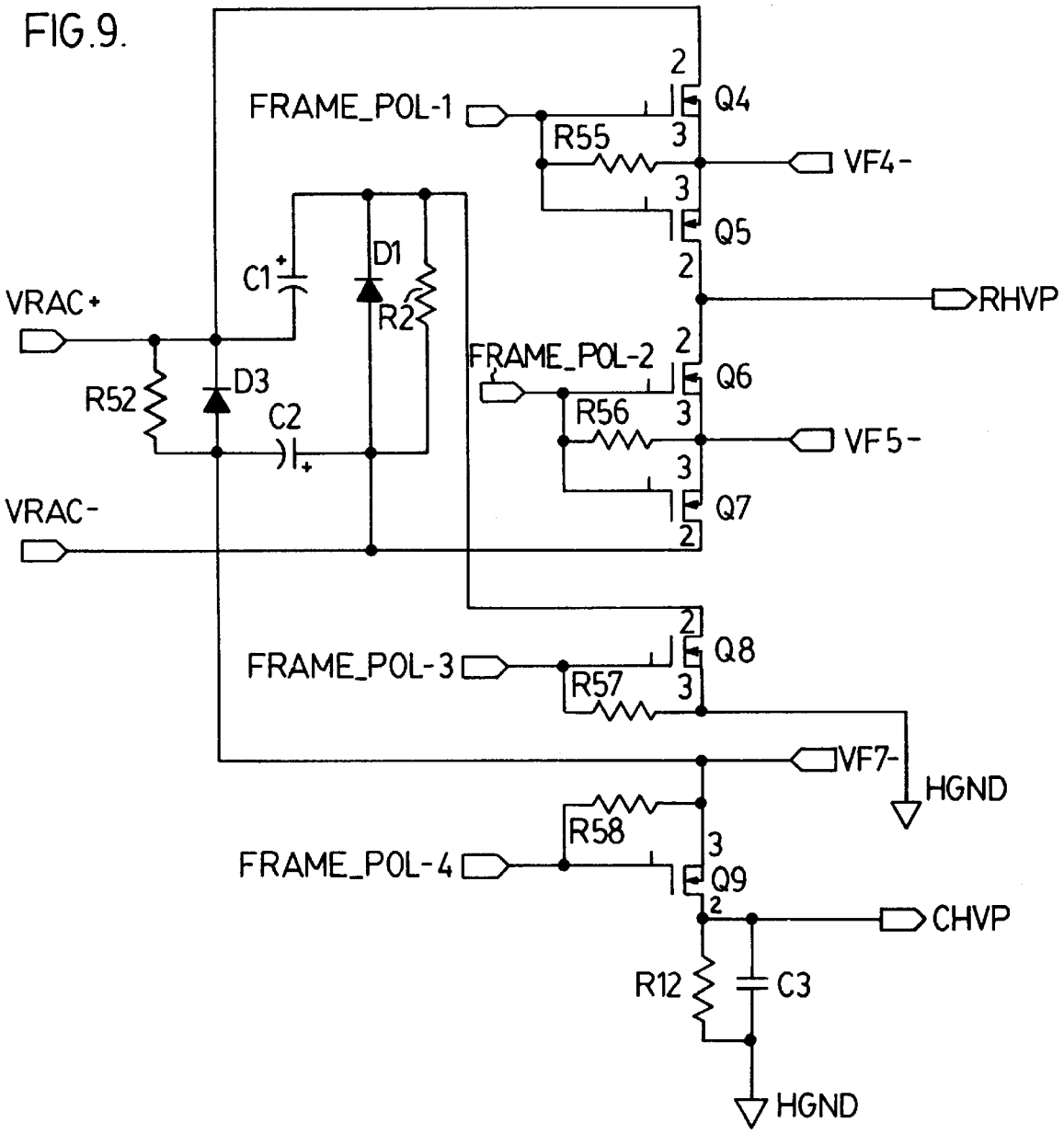
FIG. 9 is a detailed circuit diagram for a polarity reversing circuit employed at the output of the row driver of FIG. 7.

FIGS. 7 and 8 are circuit schematics for the resonant circuits according to a preferred embodiment of the present invention used for columns and rows, respectively. FIG. 9 is a circuit schematic of a polarity reversing circuit connected between the row resonant circuit and the row drivers to provide alternating polarity voltage to the row driver high voltage input pins. The input DC voltage to the resonant circuits was 330 volts (rectified off-line from 120/240 volts AC). The output of the polarity reversing circuit is connected to the high voltage input pins of the row driver IC 70 (FIG. 6), the output pins of which are connected to the rows of the display. The clock and gate input pins of the row drivers are synchronized using digital circuitry employing field programmable gate arrays (FPGA's) adapted for matrix addressing of electroluminescent displays, as known in the art.

Figure 10:
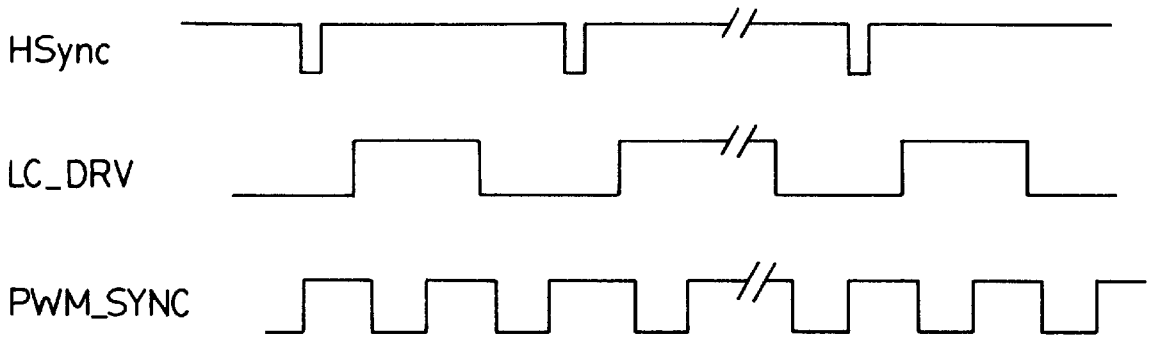
FIG. 10 and FIG. 11 are timing diagrams showing display timing pulses used in the display driver of the present invention.
Figure 11:
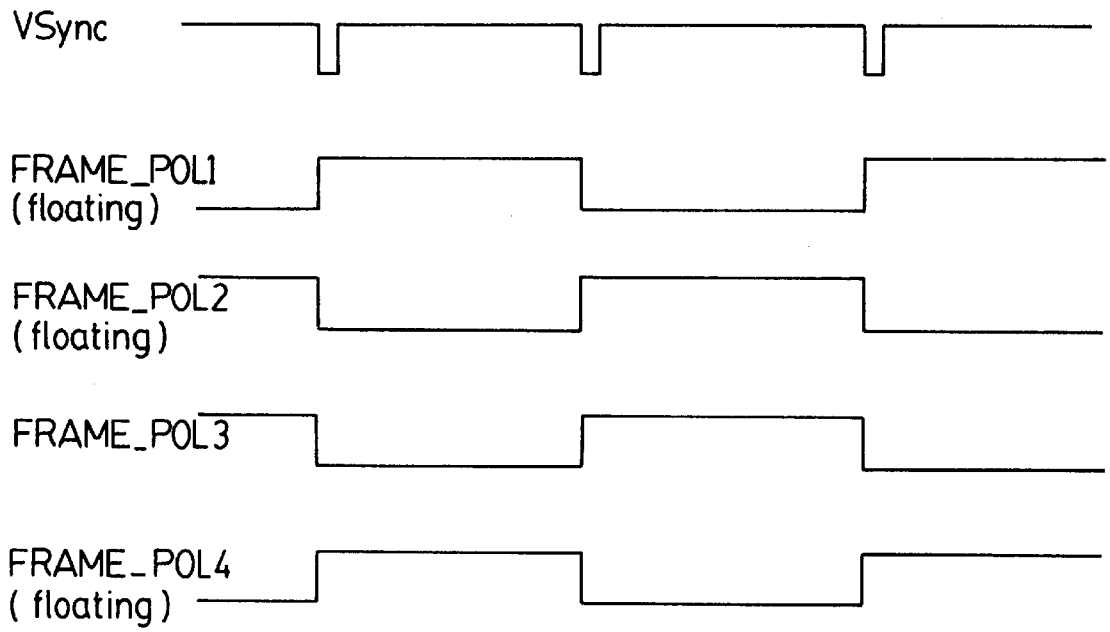

FIG. 10 and FIG. 11 shows the timing signal waveforms that are used to control the inventive driver circuit, as shown in FIGS. 6, 7, 8 and 9. The row addressing frequency for the prototype display was 32 kHz, allowing a refresh rate of 120 Hz for the display.

With reference to FIG. 7, the resonant frequency of the resonant circuit in the column driving circuit for the preferred embodiment is controlled by the effective inductance seen at the primary of the step-down transformer T2 and by the effective capacitance of the capacitor C42 in parallel with the column capacitance as seen at the primary of T2. There is also a small trimming capacitor C11 in parallel with C42 for fine tuning of the resonant frequency. The turns ratio for the transformer is greater than 5 and the value $C_1$ of the capacitor C42, with reference to equation 2, is chosen so that $C_1$ is substantially greater than $(n_2/n_1)^2\ C_p$ to minimize the effect of changes in the panel capacitance on the resonant frequency. C9 is a bank of capacitors which capacitance can be selected, in conjunction with the capacitance of C42, to obtain the desired resonant frequency to match or synchronize with different display scanning frequencies.

With further reference to FIG. 7, the sinusoidal output at the secondary of the transformer T2 is DC shifted by virtue of the capacitor C7 and the diode D7 so that the instantaneous output voltage is never negative. A further small DC shift is effected with an additional three turn secondary winding on the transformer combined with the capacitor C6 and the diode D9 to ensure that the instantaneous output voltage is always sufficiently positive for proper operation of the column driver ICs.

The resonant circuit is driven using the two MOSFETs Q2 and Q3, the switching of which is controlled by the LC DRV signal that is synchronized using an appropriate delay time with the HSync signal thereby causing the row driver ICs to select the addressed row. The delay is adjusted to ensure that switching of the row driver ICs occurs when the drive current is close to zero. The LC DRV signal is generated by the low voltage logic section of the display driver that is typically a field programmable gate array (FPGA) but may be an application specific integrated circuit (ASIC) designed for this purpose. The LC DRV signal is a 50% duty cycle TTL level square wave. The LC DRV signal has two forms: the LC DRV A signal is the complementary of the LC DRV B signal.

Again with respect to FIG. 7, control of the voltage level in the resonant circuit is achieved using the pulse width modulator U1 whose output is routed through the transformer T6 to the gate of the MOSFET Q1. This controls the voltage level in the resonant circuit by chopping the 330 volt input DC voltage. The inductor L2 limits the current in the resonant circuit as it is being energized from the DC voltage and the diode D12 limits voltage excursions at the source of the MOSFET Q1 due to current changes in the inductor. The duty cycle for the pulse width modulator is controlled by a voltage feedback circuitry in the primary of the transformer T2 to regulate or adjust the resonant circuit voltage. The switching of the pulse width modulator is synchronized with HSync using the TTL signal PWM SYNC from the low voltage logic section of the display driver.

With reference to FIG. 8, the operation of the row driver circuit for the preferred embodiment is similar to that of the column driver circuit, except that the turns ratio on the transformer T1 as compared to that of the transformer T2 in the column driver circuit is different to reflect the higher row voltages and smaller values of the panel capacitance as seen through the rows, due to the fact that the remaining rows are at open circuit. The transformer T1 also does not have the small 3 turn winding that provides the small dc offset for the column drivers, since the row voltages are bipolar and symmetric about zero volts.

In the preferred embodiment, the output of the row driver circuit feeds into the polarity reversing circuit shown in FIG. 9. This provides row voltages having opposite polarity on alternate frames to provide the required ac operation of the electroluminescent display. The diodes D1 and D3 and the capacitors C1 and C2 generate two DC shifted and phase inverted sinusoidal drive outputs. The six MOSFETs Q4 through Q9 form a set of analogue switches connecting either the positive or the negative sinusoidal drive waveforms generated to the panel rows. The selection of polarity is controlled by FRAME POL-1 through FRAME POL-4. The FRAME POL signals are signals generated by the system logic circuit in the display system. The FRAME POL signals are synchronized to the vertical synchronization signal that initiates the scanning of each frame on the display.

The power consumption of the display when operated with the driver incorporating the resonant circuit configuration of the present invention has been measured at 30 watts. The column voltage was 50 volts and the measured maximum luminosity for the display (for uniform bright white illumination) was 50 candelas per square meter. By comparison, a similar display operated to provide the same luminosity level using a conventional driver as known in the art was measured at 50 watts. The greater efficiency of the former circuit enabled a maximum voltage of 75 volts to be applied to the columns, facilitating greater display luminosity (100 candelas per square meter as opposed to 50 candelas per square meter). The power consumption at the higher luminosity was 45 watts.

Although alternate embodiments of the invention have been described herein, it will be understood by those skilled in the art that variations may be made thereto without departing from the spirit of the invention or the scope of the appended claims.

What is claimed is:

1. A driving circuit for powering an electroluminescent display using energy recovered from a varying panel capacitance ($C_p$) of said display, comprising:

a source of electrical energy;

a resonant circuit using said panel capacitance ($C_p$), for receiving said electrical energy and in response generating a sinusoidal voltage to power said display at a resonance frequency which is substantially synchronised to a scanning frequency of said display and;

circuitry for reducing effective panel capacitance ($C_p$) of said display while minimizing resistive losses attributable to high instantaneous currents.

2. The driving circuit of claim 1, wherein said circuitry further comprises a step down transformer.

3. The driving circuit of claim 2, wherein said step down transformer has a primary winding across which a further capacitance ($C_1$) is connected and a secondary winding across which said panel capacitance ($C_P$) is connected, and wherein the value of said further capacitance ($C_1$) is sufficiently large relative said panel capacitance ($C_P$) to maintain substantial synchronisation of said resonance frequency to said scanning frequency.

4. The driving circuit of claim 3, wherein said primary winding has n, turns and said secondary winding has $n_2$ turns such that $C_1 >> (n_2/n_1)^2 \times C_p$.

5. The driving circuit of claim 3, further comprising additional capacitance means for changing said resonance frequency.

6. The driving circuit of claim 1, wherein the source further comprises:

voltage means for generating a direct current voltage; and pulse width modulator means for chopping said direct current voltage into pulses of electrical energy.

7. The driving circuit of claim 2, further comprising:

control means for controlling the rate of electrical energy received by said resonant circuit to control fluctuations of said sinusoidal voltage due to a varying impedance of said display and energy usage by said display.

8. The driving circuit of claim 7, wherein said control means further comprises:

feedback means for sensing fluctuations of said sinusoidal voltage using an input from said resonant circuit.

9. The driving circuit of claim 8, wherein said input is from a primary winding of said step down transformer of said resonant circuit.

10. A driving circuit for powering columns of an addressable electroluminescent display using energy recovered from a varying column capacitance ($C_c$) said display, comprising:

a source of electrical energy;

a resonant circuit using said column capacitance ($C_c$) of said display, for receiving said electrical energy and in response generating a sinusoidal voltage to power said columns of said display at a resonance frequency which is substantially synchronised to a scanning frequency of said display and;

circuitry for reducing the effective column capacitance ($C_c$) of said display while minimizing resistive losses attributable to high instantaneous currents.

11. The driving circuit of claim 10, wherein said circuitry further comprises a step down transformer.

12. The driving circuit of claim 11, wherein said step down transformer has a primary winding across which a further capacitance ($C_1$) is connected and a secondary winding across which said column capacitance ($C_c$) is connected, and wherein the value of said further capacitance ($C_1$) is sufficiently large relative said column capacitance ($C_c$) to maintain substantial synchronisation of said resonance frequency to said scanning frequency.

13. The driving circuit of claim 12, wherein said primary winding has $n_1$ turns and said secondary winding has $n_2$ turns such that $C_1 >> (n_2/n_1)^2 \times C_c$.

14. The driving circuit of claim 12, further comprising additional capacitance means for changing said resonance frequency.

15. The driving circuit of claim 10, wherein the source further comprises:

voltage means for generating a direct current voltage; and pulse width modulator means for chopping said direct current voltage into pulses of electrical energy.

16. The driving circuit of claim 11, further comprising:

control means for controlling the rate of electrical energy received by said resonant circuit to control fluctuations of said sinusoidal voltage due to a varying impedance of said columns and energy usage by said columns.

17. The driving circuit of claim 16, wherein said control means further comprises:

feedback means for sensing fluctuations of said sinusoidal voltage using an input from said resonant circuit.

18. The driving circuit of claim 17, wherein said input is from a primary winding of said step down transformer of said resonant circuit.

19. A driving circuit for powering rows of an addressable electroluminescent display using energy recovered from a varying row capacitance ($C_r$) said display, comprising:

a source of electrical energy;

a resonant circuit using said row capacitance ($C_r$) of said display, for receiving said electrical energy and in response generating a sinusoidal voltage to power said rows of said display at a resonance frequency which is substantially synchronised to a scanning frequency of said display and;

circuitry for reducing the effective row capacitance ($C_r$) of said display while minimizing resistive losses attributable to high instantaneous currents.

20. The driving circuit of claim 19, wherein said circuitry further comprises a step down transformer.

21. The driving circuit of claim 20, wherein said step down transformer has a primary winding across which a further capacitance ($C_1$) is connected and a secondary winding across which said row capacitance ($C_r$) is connected, and wherein the value of said further capacitance ($C_1$) is sufficiently large relative said row capacitance ($C_r$) to maintain substantial synchronisation of said resonance frequency to said scanning frequency.

22. The driving circuit of claim 21, wherein said primary winding has $n_1$ turns and said secondary winding has $n_2$ turns such that $C_1 >> (n_2/n_1)^2 \times C_r$.

23. The driving circuit of claim 21, further comprising additional capacitance means for changing said resonance frequency.

24. The driving circuit of claim 19, wherein the source further comprises:

voltage means for generating a direct current voltage; and pulse width modulator means for chopping said direct current voltage into pulses of electrical energy.

25. The driving circuit of claim 20, further comprising:

control means for controlling the rate of electrical energy received by said resonant circuit to control fluctuations of said sinusoidal voltage due to a varying impedance of said rows and energy usage by said rows.

26. The driving circuit of claim 25, wherein said control means further comprises:

feedback means for sensing fluctuations of said sinusoidal voltage using an input from said resonant circuit.

27. The driving circuit of claim 26, wherein said input is from a primary winding of said step down transformer of said resonant circuit.

28. The driving circuit of claim 19, further comprising:

polarity reversing means for alternately reversing the polarity of said sinusoidal voltage applied to a row of said display.

* * * * *

UNITED STATES PATENT AND TRADEMARK OFFICE

CERTIFICATE OF CORRECTION

PATENT NO. : 6,448,950 B1
DATED : September 10, 2002
INVENTOR(S) : Chun-Fai Cheng It is certified that error appears in the above-identified patent and that said Letters Patent is hereby corrected as shown below:

Drawings,
Sheet 6, change "FIG. 7" to -- FIG. 8 --.
Sheet 7, change "FIG. 8" to -- FIG. 7 --.

Column 1,
Lines 31-36, delete "FIG. 7 is a detialed circuit diagram for a preferred embodiment of a row driver incorporating the elements of the present invention;
"FIG. 8 is a detailed circuit diagram for a embodiment of a column driver incorporating the elements of the present invention;"

and substitute with:

-- FIG. 7 is a detailed circuit diagram for a preferred embodiment of a column driver incorporating the elements of the present invention;
-- FIG. 8 is a detailed circuit diagram of a preferred embodiment of a row driver incorporating the elements of the present invention; --.

Signed and Sealed this

Fifth Day of October, 2004

JON W. DUDAS
*Director of the United States Patent and Trademark Office*